United States Patent [19]

Puckett

[11] 4,372,022

[45] Feb. 8, 1983

[54] MACHINE FOR PROGRESSIVELY CLOSING FLANGES OF CAP STRIPS ON STANDING RIB ROOFS

[75] Inventor: Hubert L. Puckett, Columbus, Miss.

[73] Assignee: The Ceco Corporation, Chicago, Ill.

[21] Appl. No.: 143,192

[22] Filed: Apr. 24, 1980

[51] Int. Cl.[3] ..... B21D 37/00

[52] U.S. Cl. ..... 29/243.58

[58] Field of Search ..... 72/48; 29/243.5, 243.57, 29/243.58, 33.5; 113/1 N, 54–58

[56] References Cited

U.S. PATENT DOCUMENTS

| | | | |
|---|---|---|---|
| 3,771,482 | 11/1973 | Thompson | 113/55 |
| 4,064,819 | 12/1977 | Fox | 113/57 X |
| 4,072,118 | 2/1978 | Schultheiss | 113/57 |
| 4,189,935 | 2/1980 | Bleyer | 113/54 R X |

*Primary Examiner*—Mark Rosenbaum

*Attorney, Agent, or Firm*—McDougall, Hersh & Scott

[57] ABSTRACT

The seaming machine has two pairs of dies which are longitudinally spaced. The dies are mounted from a frame for pivoting movement about parallel axes equally spaced on opposite sides of the longitudinal center line of the machine. A motor supported by the frame drives an eccentric and associated linkage which cause the dies to swing or oscillate laterally about said axes. The machine includes rollers adapting the machine for movement along metal roof panels of the type having their longitudinal edges configured for defining a stand rib seam. A sealing cap fits over the adjoining edges of the roof panels which form the standing rib. As the machine moves astride the cap, the dies engage and deform the sealing cap and also interlock the roof panels.

13 Claims, 16 Drawing Figures

MACHINE FOR PROGRESSIVELY CLOSING FLANGES OF CAP STRIPS ON STANDING RIB ROOFS

BACKGROUND OF THE INVENTION

The present invention relates generally to the field of machines for locking sheets of material together by deforming the edges of the sheets and by deforming a metal cap to form a common seam. More specifically, this invention relates to a machine for progressively forming a seam at the adjoining edges of metal roof sheets of the type having such edges configured to define a so-called "standing rib joint." A sealing cap encloses the edges of the roof sheets which define the standing rib. The seaming machine serves a two-fold function, viz., (1) deforming of the sealing cap to form a seal; and
(2) bending of the edge portions of the roof panels to connect the latter together simultaneously with the bending of the sealing cap.

PRIOR ART STATEMENT

Most of the machines which have been used in the past to join metal roofing panels together have been based on the roll forming principle. Such machines include a plurality of rollers to bend adjacent sheeting edges and metal caps to join roofing sheets. These machines require many rollers precisely aligned and maintained in order to produce even a moderate amount of rolling or bending of the sheet material. Depending upon the type of seam to be formed and the ductility of the sheet material, considerable difficulty is often encountered in initially mounting such prior art machines. The following U.S. Pat. Nos. are representative of these rolling forming machines: 3,609,845, 3,771,482, 3,875,642, and 4,027,611.

Additional prior art relative to the present invention is disclosed in U.S. Pat. No. 4,064,819. This patent discloses a seaming machine having a single pair of dies which are reciprocated vertically to close side flanges of an inverted U-shaped cap. The side flanges of the cap are initially disposed in vertical planes; they are deformed until they are in parallel spaced relationship with the horizontal top portion of the cap. This machine does not have the capability of bending portions of the sheets themselves or the top portion of the sealing cap.

Another prior art reference of interest is U.S. Pat. No. 4,072,118. The machine of this patent forms a seam between adjacent building panels, having mating inverted U-shaped ribs, by crimping portions of the ribs together. The machine shown in this patent is not adapted to form a seam where a cap is utilized. Moreover, the machine shown in this patent has no capability for bending the top portion of the ribs.

SUMMARY OF THE INVENTION

The primary purpose of the present invention is to provide a new and improved machine for joining sheets of material together by bending edge portions of the sheets and by simultaneously deforming a sealing cap to form a seam at the adjoining edges of the sheets.

Another purpose of the present invention is to provide a machine of the type described to join together metal roof sheets of the type having their adjoining edges configured for defining a standing rib joint.

The present machine has two pairs of pivotally mounted longitudinal dies which are oscillated between open and closed positions to deform a metal sealing cap as well as to deform adjoining edge portions of the sheets of material. The apparatus is operated by moving its inverted U-shaped frame astride a metal cap placed over adjacent edges of the sheets. These edges of the sheets define a standing rib seam. As the machine is moved along the length of the metal sealing cap, the oscillating dies progressively engage and deform the metal cap and tabs located along the edges of the sheets thereby forming a mechanically strong and weather-proof seam.

The present invention fills a need for an efficient, economical, low maintenance and easy to use machine for forming a weather-proof and mechanically secure seam joining metal roofing sheets. The machine is easily mounted in place without the need for special adjustments or tools for beginning a seam operation. The seaming machine may be readily moved along the roof panels manually. These features and advantages of the invention together with other features and advantages will become apparent from the following detailed description and from the drawings.

DETAILED DESCRIPTION

Figure 1:
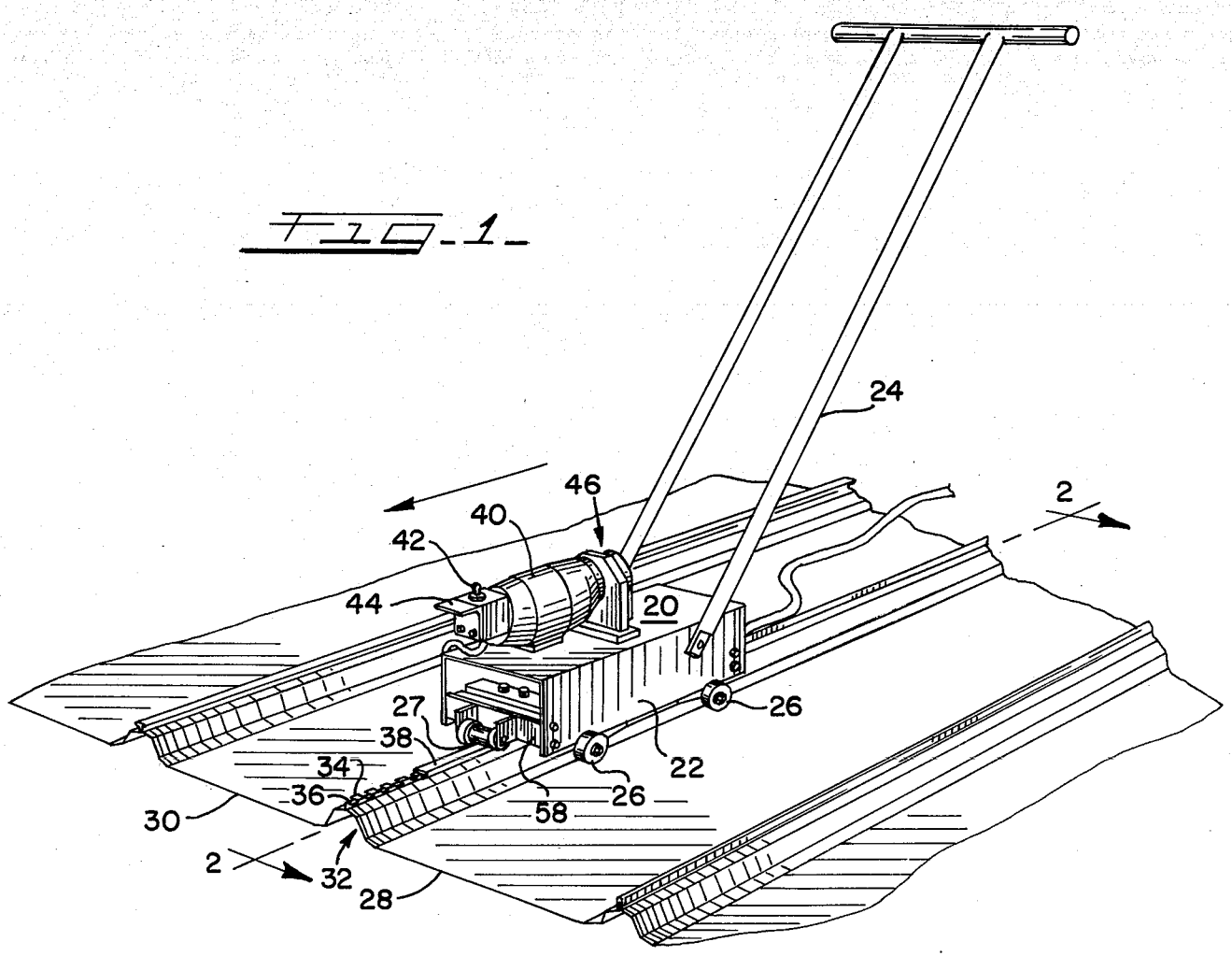
FIG. 1 is an isometric view of a machine embodying the present invention showing the machine working on roof panels of the standing rib type.

Now referring to FIG. 1, a machine 20 embodying the present invention is shown in its operating position for forming a seam at the adjoining edges of metal roof panels. The present invention has particular, although not exclusive, application for forming a seam at adjoining edges of roof panels of the standing rib type as disclosed in U.S. Pat. No. 4,168,596 which is assigned to the assignee of the present application. The embodiment of the machine of the present invention shown herein for purposes of illustration is adapted for bending the sealing cap and roof panel flanges disclosed in co-pending application, Ser. No. 151,492, and assigned to the assignee of the present invention.

Machine 20 includes an inverted U-shaped frame 22 having a handle 24 pivotally mounted to the frame. Four rollers 26 engage the roof panels and thus enable the machine to be manually pushed astride standing rib 32 in the direction shown by the arrow. Front and rear guide rollers 27 engage the sealing cap, to be described below, and aid in supporting the seaming machine.

The adjacent edges of roof panels 28 and 30 form the standing rib 32. For purposes of the present invention, the roof panels 28 and 30 may be considered to be of identical construction. Roof panel 28 has a flange formation, preferably in the form of a plurality of tabs 34, (FIGS. 1 and 10), which interlock with adjacent tabs 36 of panel 30. A metal sealing cap 38 engages the standing rib 32 so as to enclose tabs 34 and 36. As will be explained in detail below, sealing cap 38 and the interlocked tabs 34 and 36 are progressively bent by two sets of dies pivotally carried by frame 22 and by a fixed die. The pivotally carried dies are oscillated between opened and closed positions so as to bend cap 38 and tabs 34 and 36 into a weather-proof seam.

The source of power used to oscillate the two sets of dies is preferably an electric motor 40 mounted to frame 22. The electric motor 40 includes an electric switch 42 and an inverted L-shaped handle 44. An eccentric assembly 46 is driven by motor 40; the eccentric assembly and other cooperating components drive the sets of dies in an oscillating relationship as will be explained below.

Figure 2:
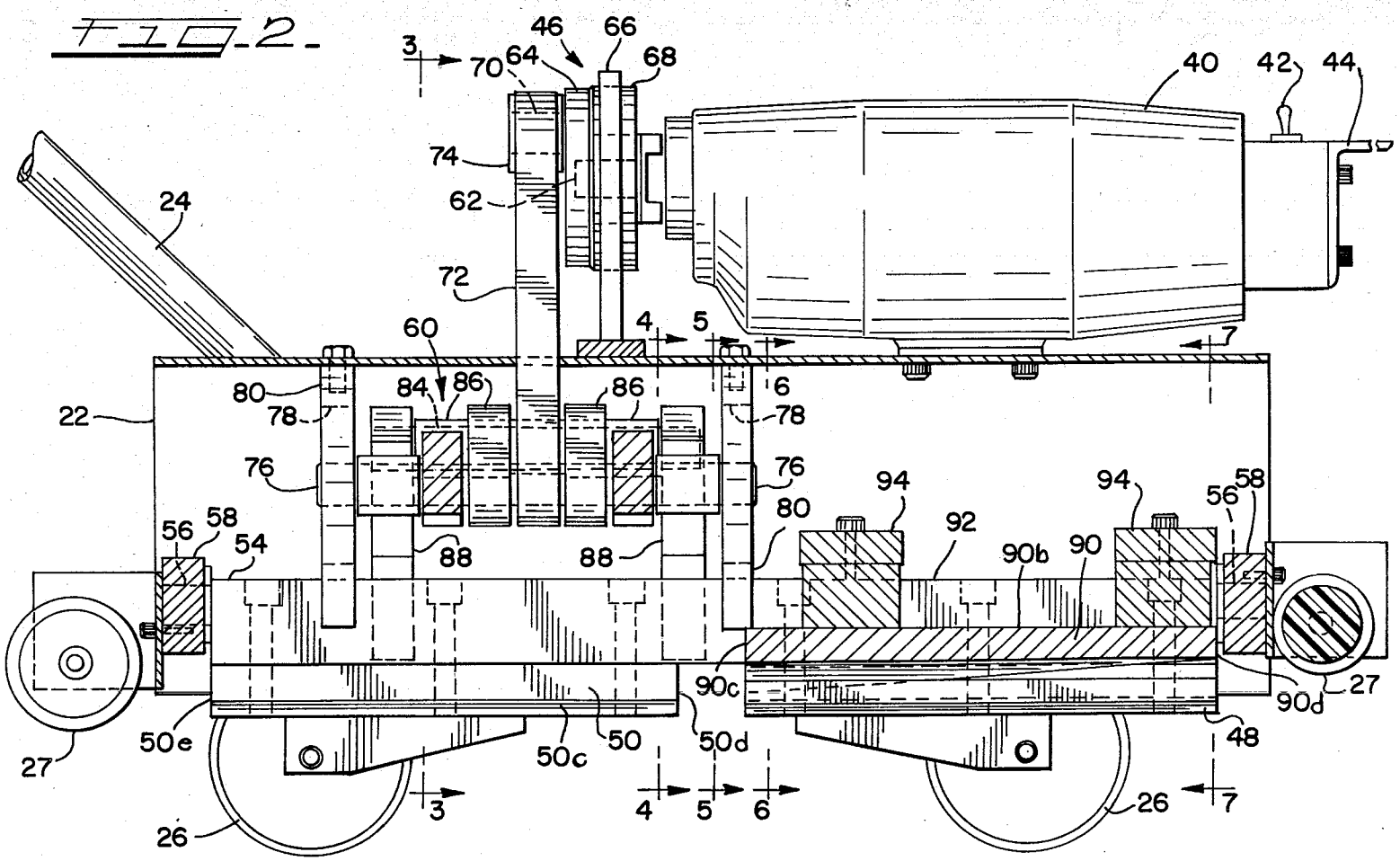
FIG. 2 is an enlarged, vertical, longitudinal section taken along the line 2—2 of FIG. 1, with the exception that the roof panels are not shown and certain parts, such as the motor, are shown in side elevation.
Figure 3:
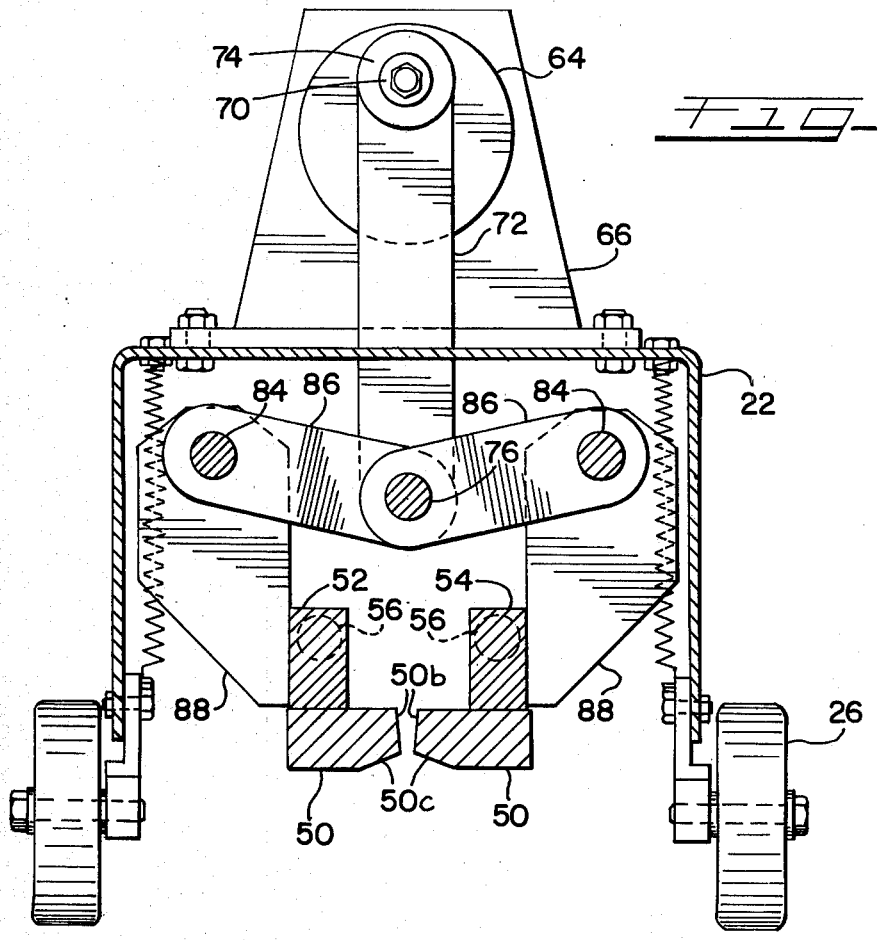
FIGS. 3–7 are sectional views taken along corresponding numbered lines in FIG. 2.
Figure 4:
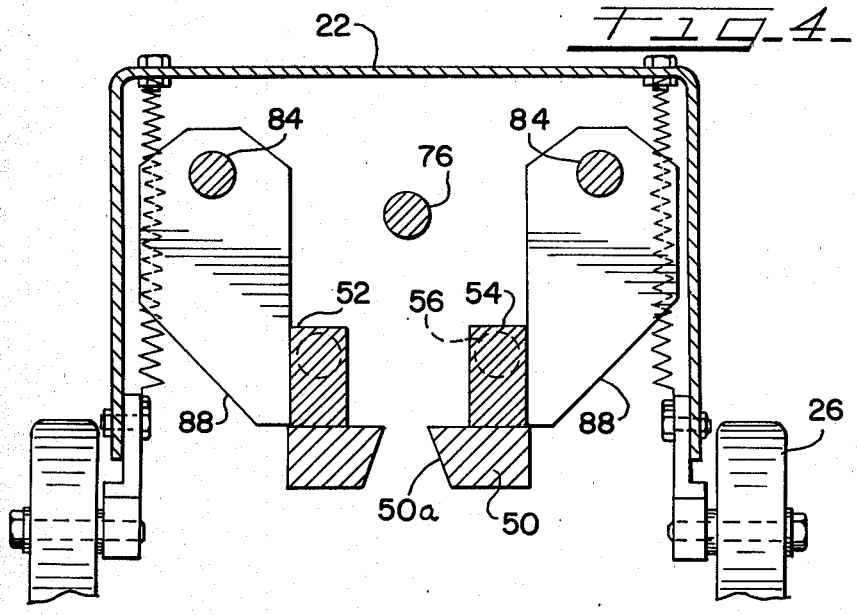
Figure 5:
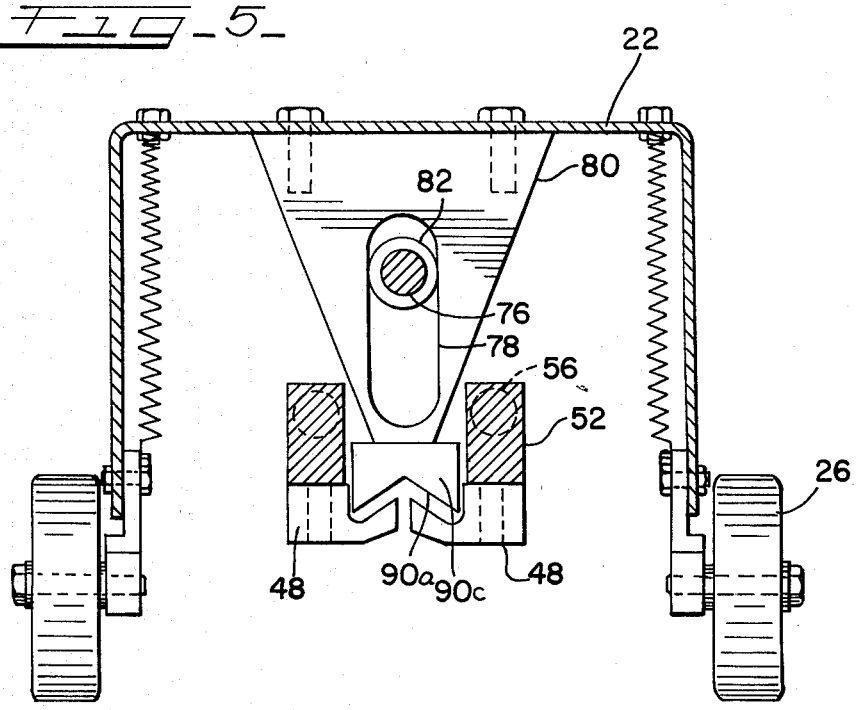

Now referring in particular to FIGS. 2, 3 and 5, a front pair of dies 48 and a rear pair of dies 50 are shown. At this time, it is helpful to point out that the machine is symetrical with respect to its longitudinal center line. Spaced parallel support bars 52 and 54 carry front pair of dies 48 and rear pair of dies 50. Pins 56 pivotally mount support bars 52 and 54 from reinforcing bars 58 which are attached to frame 22.

Electric motor 40 drives the front and rear pair of dies in an oscillatory relationship by means of eccentric assembly 46 and pivoting arm assembly 60. In this regard, shaft 62 of motor 40 drives disc 64 which is rotatably supported from mounting plate 66 by a bearing 68. A pin 70 is connected to disc 64 near the periphery of the latter. One end of crank arm 72 is coupled to pin 70 by a bearing mounting 74. As disc 64 is rotated, pin 70 travels about a circular path. Therefore, the end of crank arm 72 coupled to pin 70 is driven about a circular path as defined by the movement of pin 70. The other end of crank arm 72 extends downward into the interior of frame 22 through a slot in the top of frame 22 provided therefor.

Now referring particularly to FIGS. 2, 3, 4 and 5, pivoting arm assembly 60 transforms the previously described movement of crank arm 72 into oscillatory motion for opening and closing dies 48 and 50. The end of crank arm 72 extending into the interior of frame 22 is pivotally connected to a rod 76 (see FIG. 5) at the mid-point of the latter. Rod 76 is free to move within two vertical slots 78 formed in respective vertical support plates 80 suspended from frame 22; the ends of rod 76 are slidably supported in slots 78 by roller bearing 82. The circular motion of the end of crank arm 72 coupled to pin 70 is translated into vertical shifting movement of rod 76.

Arms 86 are pivotally connected to rod 76 and to spaced parallel rods 84. Driving arms 88 are also pivotally connected to rods 84; these arms are secured to support bars 52 and 54 as shown in FIG. 3, for example. Rods 84 move laterally in response to the changing positions of arms 86 as driven by the vertical movement of rod 76. Arms 86 operate in a scissors-like manner causing support bars 52 and 54 to pivot about pins 56 in response to vertical reciprocation of rod 76. The pivoting of the support bars causes front dies 48 and rear dies 50 to swing between open and closed positions. (FIGS. 2–7 show the front and rear dies in the closed position.)

As shown in FIG. 3, crank arm 72 is in its highest (and vertical) position causing rod 76 to assume its highest vertical position. When rod 76 is in its highest vertical position, the scissors-like action of arms 86 cause supporting bars 52 and 54 to pivot about pins 56 so as to bring the front and rear pair of dies into their closest relationship (the closed position). As disc 64 rotates, crank arm 72 travels from its highest vertical position through a continuum of intermediate positions reaching its lowest position thereby lowering rod 76 to its lowest position. As rod 76 moves from its highest to lowest position, the scissors-like action of arms 86 causes clockwise rotation of support bar 52 about pins 56 and counterclockwise rotation of support bar 54 about pins 56, thereby causing dies 48 and 50 to assume a position of maximum separation (the open position). As disc 64 continues rotating, the highest vertical positions of cranking arm 72 and rod 76 are again reached thereby returning dies 48 and 50 to their closed position. In this manner, the front pair of dies 48 and the rear pair of dies 50 are repeatedly oscillated between the open and closed positions.

Figure 6:
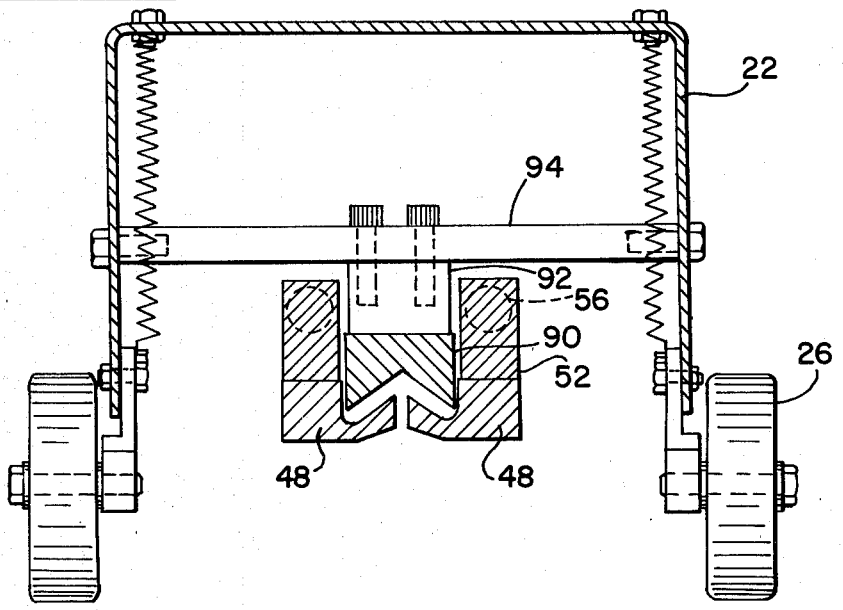
Figure 7:
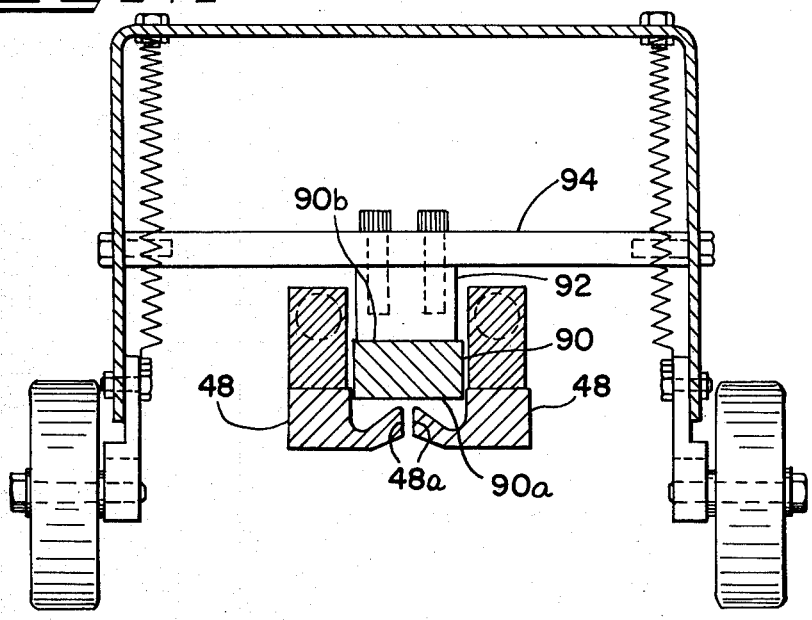

Now referring to FIGS. 2, 6 and 7, a fixed die 90 is mounted in operative relationship between and above front dies 48. Fixed die 90 is mounted to a support bar 92. A pair of horizontal support members 94 mount support bar 92 to frame 22. Thus, die 90 is held in fixed relationship with respect to frame 22.

Figure 8:
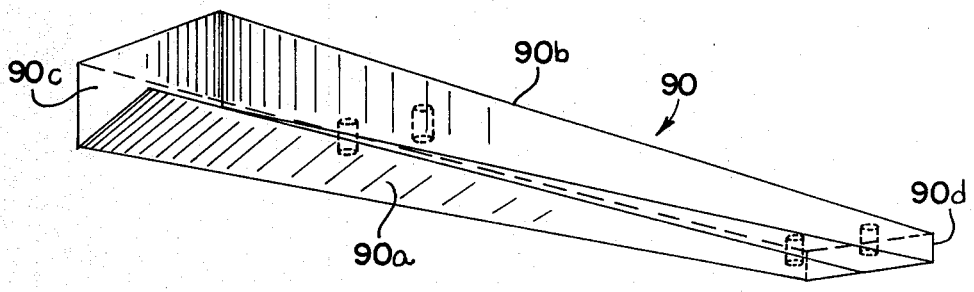
FIG. 8 is an isometric view of the fixed die of the machine embodying the present invention.

FIG. 8 best illustrates the shape of fixed die 90 which has a bottom working face **90*a*, a flat upper mounting surface 90*b* and ends 90*c* and 90*d*. Working face 90*a* is uniformly contoured from a substantially flat surface adjacent end 90*d* to an inverted V-shape surface adjacent end 90*c*. Working face 90*a* acts to bend a portion of seal cap 38** as will be described below.

The cross-sectional configuration of each of the front dies 48 is uniform along its length. As noted in FIG. 7, working faces **48*a* of dies 48 are in parallel spaced relationship when the dies are in the closed position. (The cross section of fixed die 90, as shown in FIG. 7, is taken near end 90*d* where the working face 90*a*** is substantially flat.)

Figure 9:
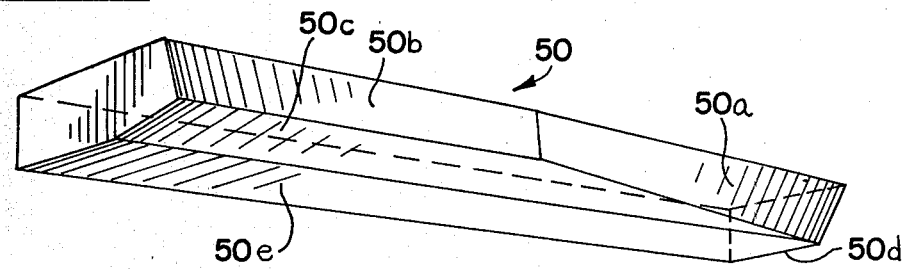
FIG. 9 is an isometric view illustrating the contoured face of one of the rear dies, the associated rear die being of identical but opposite hand construction.

FIG. 9 illustrates one of the rear dies 50 which, as already indicated, is identical but opposite hand with the other rear die. The working surfaces of die 50 comprise faces **50*a* and 50*b*. Face 50*a* has a uniformly changing contour varying from end 50*d* to its juncture with surface 50*b*. The contour of face 50*a* may be described as a helical plane surface, i.e. a surface generated by rotating a line about its midpoint while being moved normal to the plane of rotation. Face 50*b* is a planar surface. Surfaces 50*c* and 50*e*** do not perform a bending operation; these surfaces are configured to conform to the shape of the standing rib walls when the dies occupy the closed position.

Figure 10:
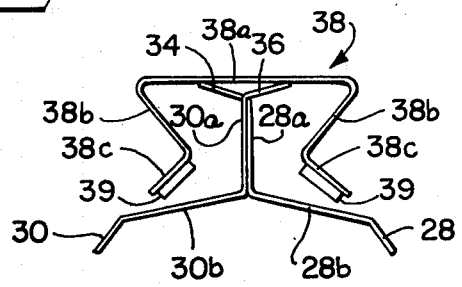
FIG. 10 is an end view showing the sealing cap seated upon adjacent edges of the roof panels.

FIG. 10 shows sealing cap 38 seated upon tabs 34 and 36 of roof panels 28 and 30. For purposes of the present invention, sealing cap 38 is defined as having a web portion **38*a*, reentrant flanges 38*b* and distal flanges 38*c*. Strips of sealant 39 extend along the length of cap 38 and are attached to the inside surface of distal flanges 38*c*. As noted in FIG. 10, roof panels 28 and 30 have respective vertical wall portions 28*a* and 30*a* and inclined wall portions 28*b* and 30*b*. Preferably, sealing cap 38 is constructed of sheet metal and sealing strips 39** are made of a resilient material impervious to moisture.

Machine 20 is initially engaged with cap 38 and standing rib 32 with motor 40 turned off and with the sets of dies in the open position. Using handles 24 and 44, front guide roller is positioned by the operator upon web portion 38*a* of the cap near the beginning of a standing rib. Machine 20 is then rolled astride the standing rib until the end of cap 38 enclosing the rib is engaged by the front set of dies. Motor 40 is then energized whereupon the sets of dies begin to oscillate. With this initial engagement completed, machine 20 can then be rolled along the length of the standing rib thereby forming a continuous seam.

FIG. 10 illustrates the initial (unbent) shape of sealing cap 38 and tabs 34 and 36. FIGS. 11–16 illustrate the progressive sequence of operation of the machine bending sealing cap 38 and interlocking tabs 34 and 36 into a seam.

Figure 11:
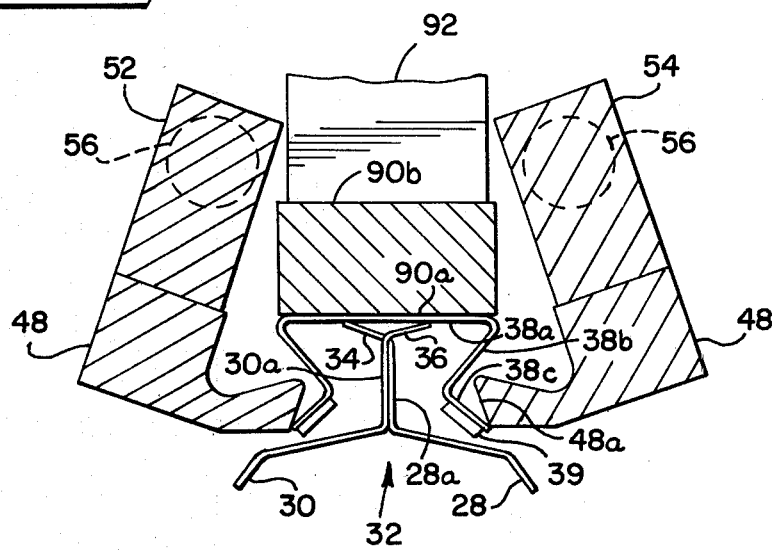
FIGS. 11–16 are progressive cross-sectional views showing the machine of the present invention in operation joining the roof panels together and bending the metal cap thereby forming a complete seam.

FIG. 11 shows standing rib 32 with web 38*a* of sealing cap 38 engaged by fixed die face 90*a* and distal flanges 38*c* engaged by faces 48*a* of the front pair of dies with the latter in the open position. This view illustrates the initial engagement by machine 20 with cap 38 and, for purposes of reference, may be considered as being taken about line 7—7 of FIG. 2.

Figures 12, 13, 14, 15, 16:
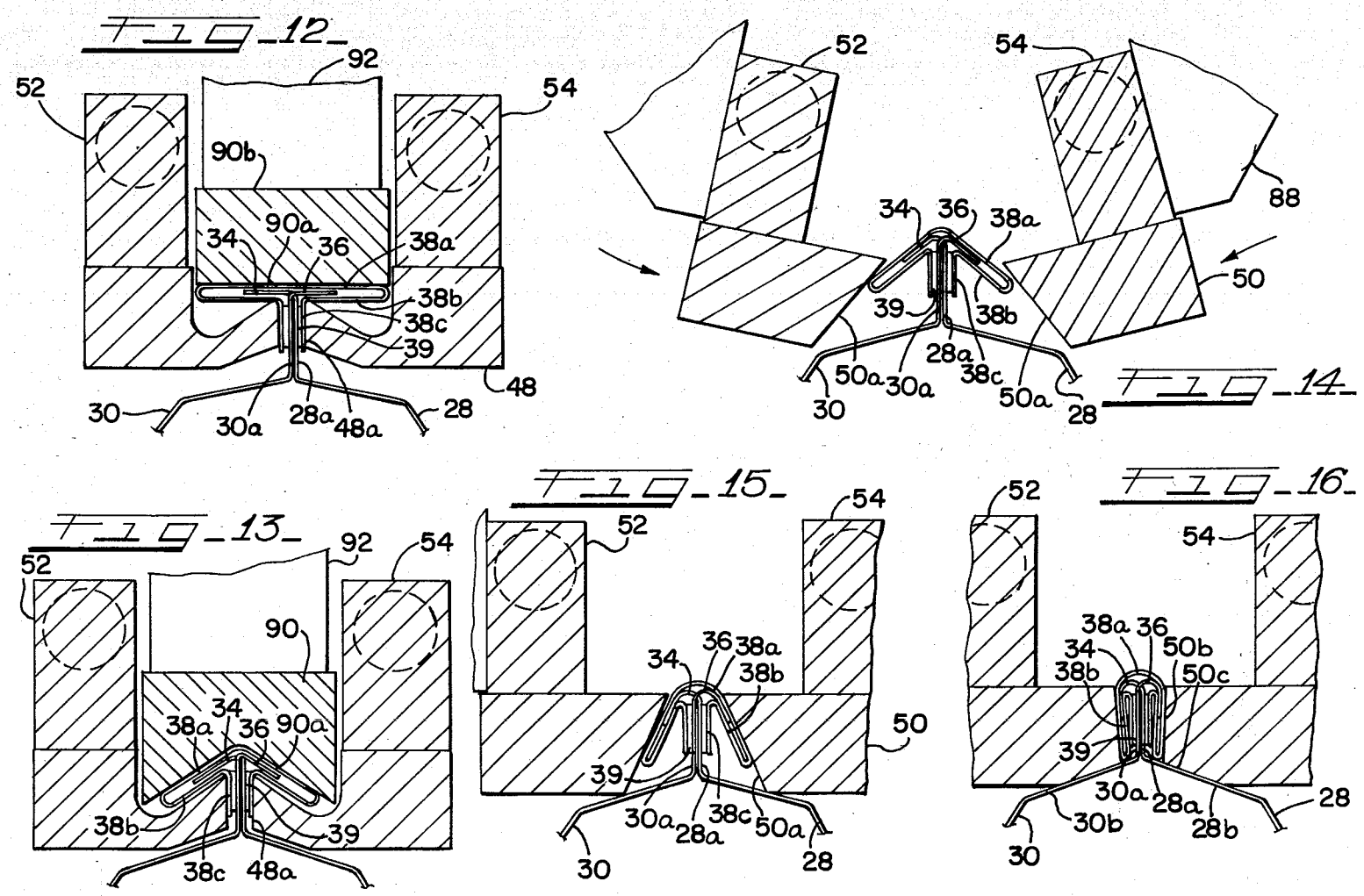

FIG. 12 is the same view as FIG. 11, but showing front dies 48 in the closed position. Working faces 48*a* bend distal flanges 38*c* parallel with vertical walls 28*a* and 30*a*; sealant strips 39 are compressed between these vertical walls and distal flanges. Comparing FIG. 11 with FIG. 12, it can be seen that tabs 34 and 36 have been bent substantially parallel to web 38*a*; the tabs have also been captivated between the inner surface of web 38*a* and reentrant flanges 38*b*.

FIG. 13 illustrates the deformation as seen at line 6—6 in FIG. 2. Again, working faces 48*a* of front dies 48 are shown in the closed position. It is noted that web 38*a* is forced to conform with the shape of working face 90*a*. Enclosed tabs 34 and 36 are also bent downwardly to a further extent along with the cap.

FIG. 14 is a cross-sectional view of rear dies 50 in the open position as would be seen along line 4—4 of FIG. 2. With rear dies 50 in the open position, working faces 50*a* allow the sealing cap 38, as preliminarily deformed by front dies 48 and fixed die 90, to enter the rear dies without interference.

FIG. 15 is the same view as in FIG. 14 but with rear dies 50 in the closed position. In this view, it is seen that working faces 50*a* engage and further bend web 38*a*, tabs 34 and 36 and reentrant flanges 38*b*. This generally inward bending decreases the space between web 38*a* and reentrant flanges 38*b* thereby tightly captivating tabs 34 and 36 therebetween. Although the dies make no direct contact with distal flanges 38*c*, these flanges maintain pressure on sealant strips 39 by forces being exerted through reentrant flanges 38*b*. The changing contour of faces 50*a* provides gradual inward bending as machine 20 advances.

FIG. 16 illustrates the completed bending of cap 38 and tabs 34 and 36 by working faces 50*b* of the rear die pair. This figure illustrates the cross section that would be seen along line 3—3 in FIG. 2. The web 38*a* of sealing cap has been bent into a substantially inverted U-shape. Tabs 34 and 36 also assume an inverted U-shape and are sandwiched between portions of web 38*a* and reentrant flanges 38*b*. Portions of reentrant flanges 38*b* have been bent inwardly to an extent where they press against the outside surfaces of distal flanges 38*c*. This pressing force maintains the compression of sealant strips 39 between distal flanges 38*c* and vertical walls 28*a* and 30*a* thereby forming a weather-proof seal.

It is now clear that the present invention provides a novel apparatus for forming a weather-proof and mechanically strong seam for sheets, such as roof panels. Front and rear die pairs are continually oscillated as machine 20 is pushed forward along a seam to be formed. The front pair of dies in conjunction with the fixed die provide initial bending to the sealing cap and tabs. The rear die pair provides the final bending.

Although the preceding description and drawings disclose the preferred embodiment of this invention, other embodiments incorporating changes and modifications are possible. The following modifications are offered by way of example. Although separate front and rear dies are utilized, a single die pair could be designed to produce the same end result. Two pairs of dies were used in the preferred embodiment because two pairs were easier to fabricate than a single pair having the required working face contours. Other means could be employed to oscillate the dies, such as a gear or pulley system driven by a power source. The scope of the instant invention is defined by the appended claims.

What is claimed is:

1. A machine for locking sheets of material together by simultaneously deforming a longitudinal metal cap and adjacent edges of said sheets into a seam, said machine comprising:

(a) a frame;

(b) a first longitudinal die pivotally carried by said frame and having a contoured face;

(c) a second longitudinal die pivotally carried by said frame, having a contoured face, and disposed laterally with respect to said first die;

(d) a motor means for repeatedly swinging said first and second dies laterally relative to each other, causing the faces of the first and second dies to oscillate between an open position and a closed position about said cap disposed between said faces, said first and second dies disposed to deform said cap as said first and second dies swing to said closed position; and (e) a means for mounting said frame for movement along said cap, whereby the closing of said die faces progressively bends said cap into a seam.

2. The machine according to claim 1 further comprising a third die immovably mounted to said frame, said third die located between the first and second dies for engaging said cap.

3. A machine for simultaneously deforming a longitudinal sealing cap and adjoining portions of sheet material to lock the same together, said machine comprising:

(a) a frame;

(b) a fixed die supported by the frame;

(c) a pair of oppositely disposed dies mounted by the frame for swinging movement generally laterally of the frame about axes extending generally parallel with the direction of movement of the machine;

(d) said pair of dies including respective first faces cooperating with the fixed die to define a forward set of die faces, which first set of die faces are arranged to engage the cap for deforming the same to an intermediate configuration;

(e) said pair of dies including respective second faces defining a rearward set of die faces, which second set of die faces engage the cap to complete bending of the same to its final configuration; and (f) motor means on the frame for imparting repeated swinging movement of the dies parallel to said axes between an open position and a closed position during movement of the machine.

4. The machine according to claim 3 wherein said fixed die includes a downwardly disposed working face which varies continuously in a direction longitudinally of the machine, the forward portion of such face being generally flat and the rearward portion of such face being of a generally inverted V-shaped configuration.

5. The machine according to claim 3 wherein each of said first die faces is substantially planar and wherein each of said second die faces includes at least a helical planar portion.

6. The machine according to claim 3 wherein the means for imparting movement to the dies include power means and linkage means for oscillating the dies to perform a hammer-like operation on the cap thereby to deform the same.

7. The machine according to claim 1 or 3 wherein said dies are disposed so that when same are in said open position an end of said cap can be received therebetween whereby said machine can engage said cap with said dies in one of the positions controlled by said motor means.

8. A machine for forming a seam between adjacent edges of metal roofing panels, wherein such panels have respective, adjoining flanges defining a standing rib joint, and wherein a longitudinal sealing cap is provided, such cap having a cross-section defined by a web, reentrant flanges and distal flanges forming a slot for receiving the standing rib, said machine comprising:

(a) a frame and mounting means for supporting the same for movement along the seam to be formed;

(b) a first set of cooperating die faces carried by the frame, such first set of faces being arranged to engage the web and distal flanges of the cap to effect preliminary bending thereof; and (c) a second set of cooperating die faces carried by the frame for engaging the web of the sealing cap at the areas thereof adjacent the reentrant flanges thereby to bend said web into its final symmetrical configuration, said first set and said second set of die faces each including a pair of oppositely disposed die faces mounted for swinging movement between an open position and a closed position generally laterally of the frame about parallel axes extending longitudinally of the frame.

9. The machine according to claim 8 further defined by a fixed die having a working face defining one of the die faces of the first set of cooperating die faces.

10. The machine according to claim 8 further defined by a fixed die having a working face defining one of the die faces of the first set of cooperating die faces.

11. The machine according to claim 10 wherein the working face of the fixed die varies continuously in the direction of movement of the machine, such working face being generally flat at its forward end and being of generally inverted V-shape at its rearward end.

12. The machine according to claim 8 wherein said second set of cooperating die faces comprise a pair of oppositely disposed contoured faces having at least a portion of same defining helical planar surfaces.

13. The machine according to claim 8 wherein said first set of die faces are disposed so that when same are in said open position an end of said cap can be received therebetween allowing said machine to initially engage said cap.

* * * * *